US008506462B2

(12) United States Patent
Gregor et al.

(10) Patent No.: US 8,506,462 B2
(45) Date of Patent: Aug. 13, 2013

(54) EXERCISE APPARATUS

(76) Inventors: Matthew Gregor, Cleveland Heights, OH (US); Doug Halley, Westlake, OH (US)

( * ) Notice: Subject to any disclaimer, the term of this patent is extended or adjusted under 35 U.S.C. 154(b) by 314 days.

(21) Appl. No.: 12/896,141

(22) Filed: Oct. 1, 2010

(65) Prior Publication Data

US 2012/0083394 A1 Apr. 5, 2012

(51) Int. Cl.

*A63B 21/02* (2006.01)
*A63B 21/04* (2006.01)
*A63B 22/20* (2006.01)

(52) U.S. Cl.

USPC ..... 482/142; 482/121; 482/122; 482/123; 482/129

(58) Field of Classification Search

USPC ..... 482/121, 122, 123, 124, 125, 126, 482/129, 130, 142; D21/662, 686, 690

See application file for complete search history.

(56) References Cited

U.S. PATENT DOCUMENTS

| | | | | |
|---|---|---|---|---|
| 1,621,477 | A | 3/1927 | Pilates | |
| 3,770,267 | A | 11/1973 | McCarthy | |
| 4,084,815 | A | 4/1978 | Flannery | |
| 4,706,953 | A | 11/1987 | Graham | |
| 4,884,802 | A | 12/1989 | Graham | |
| 5,066,005 | A | 11/1991 | Luecke | |
| 5,338,278 | A | 8/1994 | Endelman | |
| 5,607,381 | A | 3/1997 | Endelman | |
| 5,653,670 | A | 8/1997 | Endelman | |
| 5,681,249 | A | 10/1997 | Endelman | |
| 5,792,033 | A | 8/1998 | Merrithew | |
| 5,827,154 | A * | 10/1998 | Gill | 482/9 |
| 6,042,523 | A * | 3/2000 | Graham | 482/121 |
| 6,120,425 | A | 9/2000 | Endelman | |
| 6,186,929 | B1 | 2/2001 | Endelman et al. | |
| 6,267,711 | B1 * | 7/2001 | Hinds | 482/121 |
| 6,338,704 | B1 | 1/2002 | Endelman | |
| 6,371,895 | B1 | 4/2002 | Endelman et al. | |
| 6,527,685 | B2 | 3/2003 | Endelman et al. | |
| 6,926,650 | B2 | 8/2005 | Endelman et al. | |
| 6,939,278 | B2 * | 9/2005 | Atwell | 482/142 |
| 6,971,976 | B2 | 12/2005 | Endelman et al. | |
| 7,101,326 | B2 * | 9/2006 | Gerschefske et al. | 482/129 |
| 7,104,937 | B2 | 9/2006 | Arbuckle et al. | |
| 7,125,369 | B2 | 10/2006 | Endelman | |
| 7,163,500 | B2 | 1/2007 | Endelman et al. | |
| 7,288,053 | B2 | 10/2007 | Endelman et al. | |
| 7,288,054 | B2 | 10/2007 | Endelman et al. | |
| 7,294,098 | B2 | 11/2007 | Barnard et al. | |
| 7,465,261 | B2 | 12/2008 | Barnard et al. | |
| 7,524,273 | B1 | 4/2009 | Martin | |

(Continued)

*Primary Examiner* — Loan Thanh
*Assistant Examiner* — Sundhara Ganesan
(74) *Attorney, Agent, or Firm* — Brouse McDowel; Heather M. Barnes

(57) ABSTRACT

An exercise device has a first frame, where the first frame is generally rectangular and has a head end and a first juncture end. A fixed body support is fixed on the first frame and is configured to support a torso of an exercise participant. A second frame has a second juncture end, a foot end and a pair of rail members extending along opposite sides of the second frame, respectively, between the second juncture end and the foot end. A carriage is mounted on the second frame for movement along the rail members along locations confined between the second juncture end and the foot end. Wheels mounted to the carriage facilitate movement of the carriage along the rail members, among other things, prevent the carriage from tilting upwardly as it is driven toward the foot end.

20 Claims, 16 Drawing Sheets

(56) References Cited

U.S. PATENT DOCUMENTS

| | | | | |
|---|---|---|---|---|
| 7,674,211 | B2 | 3/2010 | Uygan | |
| 7,682,297 | B2 | 3/2010 | Graham | |
| 7,803,095 | B1 * | 9/2010 | LaGree | 482/140 |
| 2001/0056011 | A1 | 12/2001 | Endelman et al. | |
| 2002/0058573 | A1 | 5/2002 | Endelman et al. | |
| 2003/0119635 | A1 | 6/2003 | Arbuckle et al. | |
| 2003/0195095 | A1 | 10/2003 | Endelman et al. | |
| 2004/0167000 | A1 * | 8/2004 | Schwarz | 482/123 |
| 2004/0176227 | A1 | 9/2004 | Endelman | |
| 2004/0248713 | A1 | 12/2004 | Campanaro et al. | |
| 2005/0113226 | A1 | 5/2005 | Endelman et al. | |
| 2005/0113227 | A1 | 5/2005 | Endelman et al. | |
| 2006/0199712 | A1 * | 9/2006 | Barnard et al. | 482/142 |
| 2007/0087921 | A1 | 4/2007 | Graham | |
| 2007/0135280 | A1 * | 6/2007 | Hamer | 482/132 |
| 2007/0219053 | A1 * | 9/2007 | Barufka et al. | 482/4 |
| 2008/0058174 | A1 | 3/2008 | Barnard et al. | |
| 2008/0248935 | A1 | 10/2008 | Solow et al. | |
| 2009/0143201 | A1 | 6/2009 | Uygan | |
| 2009/0247376 | A1 | 10/2009 | Merrithew et al. | |
| 2010/0004101 | A1 | 1/2010 | Solow et al. | |
| 2010/0016131 | A1 | 1/2010 | Hoffman | |

* cited by examiner

EXERCISE APPARATUS

BACKGROUND OF INVENTION

Joseph Pilates invented (see U.S. Pat. No. 1,621,477) an exercise machine provided with a carriage that supports the user's body in a recumbent position, and which is movable against resistance provided thereto by the weight of the body and weights attached to the carriage by a cord and passing over a pulley. The user lies on the carriage and pushes against a fixed portion of the machine to move the carriage against the resistance of the body weight on the carriage and weight attached by the cord.

Current apparatuses based on the pioneering work of Joseph Pilates are typically referred to as "reformer" apparatuses and also include a body supporting carriage that is movable along a set of tracks provided in a frame. Resistance elements such as springs connect the carriage to the foot end of the frame. Also, a foot bar is fixed to a foot end of the frame. The user lies on the carriage and pushes with the user's feet against the foot bar to move the carriage and the user's body away from the foot bar, against the forces of the springs and the user's body weight on the carriage.

Typically, hand operated cords are provided that loop through pulleys that are fixed to a non-movable part of the apparatus, and with ends of the cords being attached to the carriage. This permits the user to alternatively pull on the hand cords to move the carriage against the resistance of the springs and the body weight supported on the carriage.

Although reformer type apparatuses of the type described above are very popular and effective, they tend to be expensive and not very portable and are typically limited to studio use offering Pilates exercise programs with the aid of a Pilates trainer. As such, there is a need for equipment for performing Pilates type exercise routines that is more affordable than the reformer apparatuses that are currently available. It would also be desirable to provide apparatus, all or a part of which is more portable than the former apparatuses that are currently available.

Current reformer type apparatuses may not be usable by some segments of the population, even if they can afford the costs. For example, patients needing various types of rehabilitation or strength training may not have sufficient strength to move the carriage of a reformer apparatus when it is supporting the patient's body weight. This can be true for either use in exercising the legs or the arms, but is more often the case when exercising the arms, by grasping the cords and attempting to move the carriage by pulling. Similarly, some users who have particular disabilities are not able to perform certain core Pilates choreography and exercises typically done on a currently available reformer apparatus because certain exercises requires a user to lift their legs in the air in order for the carriage to move along the track. It would be desirable to provide apparatus that is usable in these instances so that the user could perform a Pilates type routine without being required to move a carriage supporting the main body weight (e.g., weight of the torso) or lift both legs in the air to perform the exercise.

One of the most fundamental aspects of the Pilates Method is the rehabilitation of the abdomen. On a traditional reformer apparatus, there are a series of exercises that are important teaching tools on the correct way to utilize the abdominal muscles. However, because of the current design of traditional reformers, the user has to lift their legs in the air in order to allow the mechanics of the machine to work. A great percentage of users do not have the ability to lift their legs in this manner and then use the abdomen in the correct way. For this percentage of users, they cannot perform some of the most vital exercises in the Pilates method. One of the purposes of the present invention is to correct this shortcoming.

Yet another problem encountered by traditional reformer apparatus is the "fear response" effect. Current designs of reformers require the user, that while lying in the recumbent position, results in the user's body to move back and forth in space. For a great percentage of users this cause a subtle fear response. The fear response is usually unconscious; however, for those familiar with this art the fear response affects the user's nervous system first, which then impacts and cause an incorrect usage of their body and muscles when performing certain exercises. More specifically, the fear response often causes the user to rotate their pelvis into the carriage which immediately forces the user to become dependent on using the quadricep muscles to perform certain exercise. The fear response also causes the user to shorten their cervical spine and lumbar spine thereby becoming dependent on the habitual use of muscle groups to perform exercises when the client should be learning how to keep these muscle groups neutral. The present invention solves this problem and enables the user a greater ability to grow out of their spine and engage the deeper core muscles.

The present invention meets all of the above-noted current need and desires and more, as described in more detail below.

SUMMARY OF THE INVENTION

According to one aspect of the present invention, a new and improved exercise device comprises a first frame, the first frame being generally rectangular and having a head end and a first juncture end; a fixed body support fixed on the first frame and configured and dimensioned to support a-torso of an exercise participant; a second frame, the second frame being generally rectangular and having a second juncture end, a foot end and a pair of rail members extending along opposite sides of the second frame, respectively, between the second juncture end and the foot end; a carriage mounted on the second frame for movement along the rail members along locations confined between the second juncture end and the foot end; and wheels mounted to the carriage to facilitate movement of the carriage along the rail members, support the weight of the carriage, maintain alignment of the carriage between the rail members and prevent the carriage from tilting upwardly as it is driven toward the foot end.

Another object of the present invention is to provide an exercise apparatus, wherein each rail member is a channel being substantially C-shaped in cross section, each rail member having a vertical wall, a top wall, a bottom wall and an opening forming the C-shaped cross section, the openings of the C-shapes of the rail members facing toward one another from the opposite sides of the second frame, and wherein the wheels comprise at least one wheel contacting the vertical wall, at least one wheel contacting the top wall and at least one wheel contacting the bottom wall on each of the rail members.

Another object of the present invention is to provide an exercise apparatus, wherein the fixed body support has a first length, the carriage has a second length, and wherein the first length is greater than the second length.

Another object of the present invention is to provide an exercise apparatus, further comprising a foot bar assembly adjustably mounted to the carriage.

Another object of the present invention is to provide an exercise apparatus, further comprising at least one elongated elastic member extending between the carriage and a portion of the apparatus on the first juncture end of the first frame or closer to the head end of the first frame than the first juncture end.

Another object of the present invention is to provide an exercise apparatus, wherein the apparatus is foldable to stack the first frame on the second frame.

Another object of the present invention is to provide an exercise apparatus, further comprising a storage compartment beneath at least a portion of the fixed body support, wherein the at least a portion of the fixed body portion opens to provide access to the storage compartment and closes to a closed position used when supporting the exercise participant.

Another object of the present invention is to provide an exercise apparatus, further comprising a pair of spaced shoulder stops and a head rest, wherein the head rest is adjustably mounted to the fixed body support.

Another object of the present invention is to provide an exercise apparatus, further comprising a foot board adjustably mounted to the carriage and positionable substantially vertically relative to the second frame.

Another object of the present invention is to provide an exercise apparatus, further comprising a post removably mounted to the head end of the first frame, the post extending vertically above the head end of the first frame.

Another object of the present invention is to provide an exercise apparatus, further comprising an elongated elastic member connected to the post and at least one actuator provided on an end portion of the elongated elastic member and configured to be engaged by a hand or foot of the exercise participant.

Another object of the present invention is to provide an exercise apparatus, further comprising a yoke configured to connect the elongated elastic member to the post, wherein the elongated elastic member loops through an opening of the yoke, wherein a first of the at least one actuator is provided on a first end portion of the elongated elastic member and wherein a second of the at least one actuator is provided on a second end portion of the elongated elastic member.

Another object of the present invention is to provide an exercise apparatus, further comprising a flat pad configured and dimensioned to overlie the second frame and the carriage.

Another object of the present invention is to provide an exercise apparatus, further comprising a housing adapted to be connected to the post; a plurality of elongated elastic members, each the member having a first end and a second end; at least a first end of each the elastic member fixed to the housing; and at least one actuator provided on a second end or second end portion of at least one of the elongated elastic members.

Another object of the present invention is to provide an exercise apparatus, further comprising a receptor provided on the second end or second end portion of the at least one elongated elastic member; and a rigid elongated member having a mating receptor on at least one end of the rigid elongated member; wherein the mating receptor is configured to be engaged with the receptor by the exercise participant for use in extending the at least one elongated elastic member to facilitate engagement of the actuator by a foot of the exercise participant.

Another object of the present invention is to provide an exercise apparatus, wherein one of the elongated elastic members comprises both of the first and second ends fixed to the housing; and a second receptor intermediate the first and second ends; wherein the rigid elongated member is configured to engage the second receptor at location intermediate of first and second ends of the rigid elongated member.

Another object of the present invention is to provide an exercise apparatus, comprising a housing; a plurality of elongated elastic members, each the member having a first end and a second end; at least a first end of each the elastic member fixed to the housing; and at least one actuator provided on a second end or a second end portion of at least one of the elongated elastic members.

Another object of the present invention is to provide an exercise apparatus, wherein the elongated elastic member is configured to be engaged by a hand or foot of the exercise participant.

Another object of the present invention is to provide an exercise apparatus, wherein one of the elongated elastic members comprises both of the first and second ends fixed to the housing; and a receptor intermediate the first and second ends.

Another object of the present invention is to provide an exercise apparatus, further comprising a rigid elongated member having first and second ends, where the rigid elongated member is configured to engage the receptor at a location intermediate of first and second ends of the rigid elongated member.

Another object of the present invention is to provide an exercise apparatus, which is easy to use and cost effective to manufacture.

Another object of the present invention is to provide an exercise apparatus, wherein the user is able to easily and correctly engage their abdominal muscles.

Another object of the present invention is to provide an exercise apparatus, wherein fear response is eliminated or substantially reduced.

Still other benefits and advantages of the invention will become apparent to those skilled in the art to which it pertains upon a reading and understanding of the following detailed specification.

BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

DETAILED DESCRIPTION OF THE INVENTION

Before the present apparatus, devices and methods are described, it is to be understood that this invention is not limited to particular embodiments described, as such may, of course, vary. It is also to be understood that the terminology used herein is for the purpose of describing particular embodiments only, and is not intended to be limiting, since the scope of the present invention will be limited only by the appended claims.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed within the invention. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included in the invention.

Unless defined otherwise, all technical and scientific terms used herein have the same meaning as commonly understood by one of ordinary skill in the art to which this invention belongs. Although any methods and materials similar or equivalent to those described herein can be used in the practice or testing of the present invention, the preferred methods and materials are now described. All publications mentioned herein are incorporated herein by reference to disclose and describe the methods and/or materials in connection with which the publications are cited.

It must be noted that as used herein and in the appended claims, the singular forms "a", "an", and "the" include plural referents unless the context clearly dictates otherwise. Thus, for example, reference to "an actuator" includes a plurality of such actuators and reference to "the elongated elastic member" includes reference to one or more elongated elastic members and equivalents thereof known to those skilled in the art, and so forth.

The publications discussed herein are provided solely for their disclosure prior to the filing date of the present application. Nothing herein is to be construed as an admission that the present invention is not entitled to antedate such publication by virtue of prior invention. Further, the dates of publication provided may be different from the actual publication dates which may need to be independently confirmed.

Figure 1A:
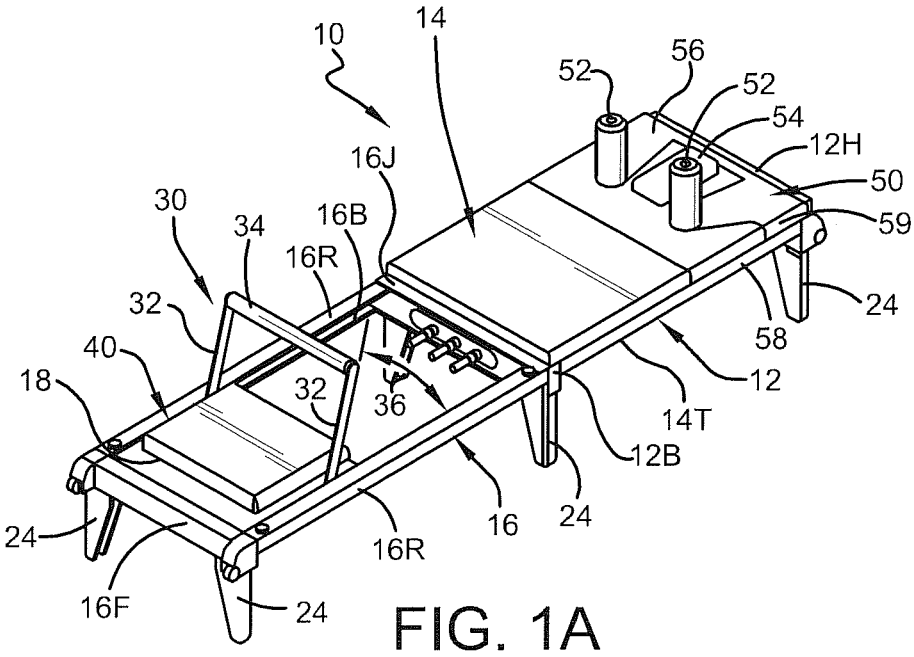
FIG. 1A is a perspective view of the present invention.

FIGS. 1A through 14D illustrate the present invention and various embodiments thereof. A perspective view of an exercise apparatus 10 according to an embodiment of the present invention is shown in FIG. 1A. Apparatus 10 includes a first frame 12 that is generally rectangular and has a head end 12H and a first juncture end 12J. First frame 12 is constructed of weight bearing structural material such as aluminum, steel or the like and is configured to support the weight of the components mounted thereof as well as the full weight of a user during exercise. Typically, the frame 12 will support at least the weight of the torso of the user, as well as any forces applied thereto during exercise maneuvers.

A fixed body support 14 is mounted on top of frame 12 and is fixed thereto, such as by bolts, screws, adhesives or the like. Body support 14 includes a padded top portion 14T and a structural support 14S underlying the top portion 14T to ensure that the user can be safely supported thereon. Structural support 14S may be sheet metal, plywood, or other structural member having sufficient strength to support the weights and forces provided to the body support 14 when exercises are performed. In one embodiment of the present invention, the apparatus 10 is able to be adjusted so that the surface is 14-16 inches off the ground so that people who have more serious physical problems do not have to go all the way to the ground to do the exercises.

A second frame 16 is provided. Frame 16 is generally rectangular and has a second juncture end 16J, a foot end 16F and a pair of rail members 16R extending along opposite sides thereof, respectively, between the second juncture end 16J and the foot end 16E.

A carriage 18 is mounted on the second frame 16 for movement along the rail members 16R. The carriage 18 is mounted between the rail members 16R, by insertion of carriage wheels 20B, 20S and 20T within the C-shaped channels. FIGS. 14A-14D show the interrelationship between wheels $\mathbf{20}B_1$, $\mathbf{20}B_2$, $\mathbf{20}S_1$, $\mathbf{20}S_2$ and 20T with the C-shaped channel of the rail member 16R. Thus, movements of carriage 18 are confined between the foot end 16F and the second juncture end 16J of the second frame 16

Figure 2:
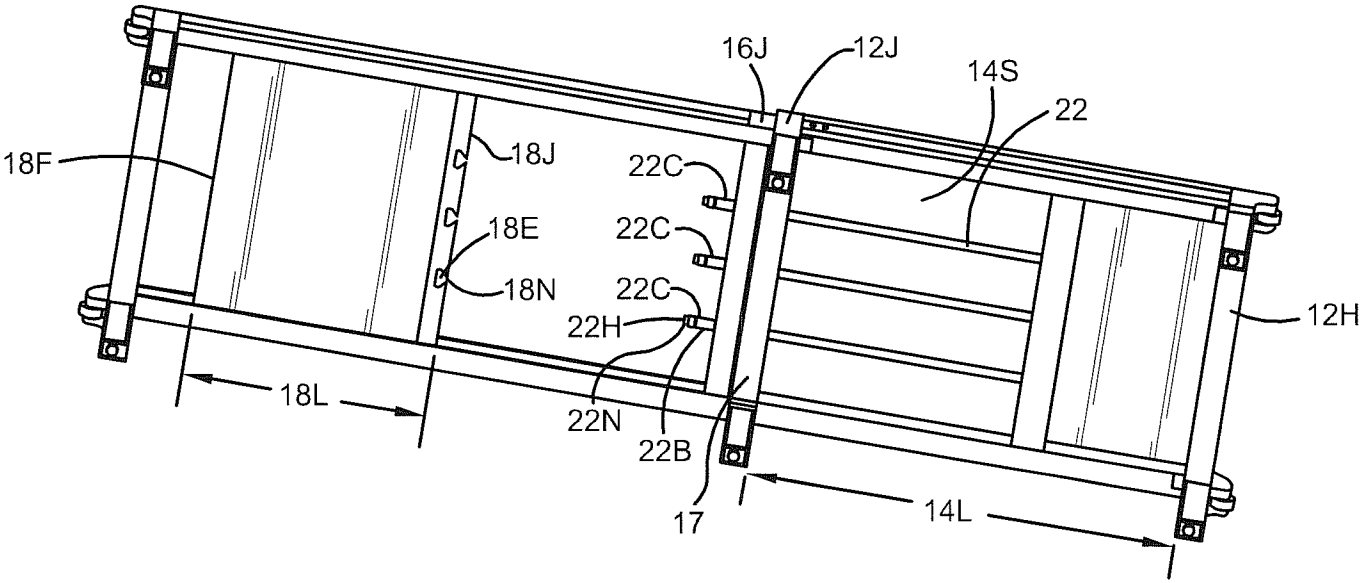
FIG. 2 is a bottom perspective view of FIG. 1A of the present invention.

Wheels $\mathbf{20}B_1$, $\mathbf{20}B_2$, $\mathbf{20}S_1$, $\mathbf{20}S_2$ are mounted to the carriage to facilitate movement of the carriage 18 along the rail members 16R, support the weight of the carriage 18, maintain alignment of the carriage 18 between the rail members 16R and prevent the carriage 18 from tilting upwardly as it is driven toward the foot end 16F. Carriage 18 has a foot end 18F that is relatively nearer to the foot end 16F of frame 16 than juncture end 18J is when carriage 18 is mounted in rails 16R as shown in FIGS. 1A and 2. Bottom wheels $\mathbf{20}B_1$ are connected to carriage 18 via a horizontal axle on each side of carriage 18 near the foot end 18F, and side wheels $\mathbf{20}S_1$ are connected to carriage 18 via a vertical axle on the same side of carriage 18 near the foot end 18F. A bottom wheels $\mathbf{20}B_2$ are connected to carriage 18 via a horizontal axle on each side of carriage 18 near the juncture end 18J, and side wheels $\mathbf{20}S_2$ are connected to carriage 18 via a vertical axle on the same side of carriage 18 near the juncture end 18J. Additionally, top wheels 20T are connected to carriage 18 via horizontal axle on the same side of carriage 18 near the juncture end 18J. As the carriage 18 moves along the channels of rail members 16R, all of the bottom wheels $\mathbf{20}B_1$, $\mathbf{20}B_2$ remain in contact with the bottom inside surfaces 16B of the C-shaped channels, thereby supporting the weight of the carriage and any downward forces that may be applied through, the carriage. All of the side wheels $\mathbf{20}S_1$, $\mathbf{20}S_2$ remain in contact with the inside vertical surfaces 16V of the channels, and thereby maintain the alignment of the carriage 18 relative to the frame 16, as it moves along the channels. Both top wheels 20T remain in contact with the inside top surfaces 16T of the channels, thereby preventing tilting up of the juncture end 18J of the carriage when torque is applied to it by pushing on the foot bar 40 or foot board 40 in a manner described below. Because the carriage 18 is relatively short and does not support the weight of the body of the user, especially not the torso, main body weight portion of the user, it would be more susceptible to tilting upward when forces are applied by the foot or feet of the user against the foot bar or foot board, if not prevented from such tilting by the contact of top wheels 20T against the inside top surfaces of the channels of rails 16R.

The length 18L of carriage 18 is significantly less than the length 14L of fixed body support 14. For example, length 18L may range from about twelve to about twenty-four inches and length 14L may range from about thirty-nine to about forty-two inches. In one particular embodiment, length 18L was about sixteen inches and length 14L was about forty inches. By providing a relatively small, short and lightweight carriage 18, as well as not carrying the weight of the torso of the user on the carriage 18, and providing a variable selection of resistances to be applied to the carriage 18, this helps facilitate use of the present invention by users who do not have sufficient strength or ability to perform some of the exercises on currently available reformer apparatuses that use a carriage that supports the weight of the user's torso and requires the user to perform exercises with sufficient force to pull the user's body weight along with the carriage or that requires the strength and ability of the user to lift the weight of said user's limbs in the air for prolonged periods of time in order for the carriage to move along the track.

Elongated elastic members 22 are provided as resistance elements 22 that can be adjusted to apply variable amounts of resistance against moving the carriage 18 in a direction away from the foot end 16F of the frame 16 Elongated elastic members 22 may be springs or other elongated members having a spring constant, but in the example shown in FIG. 2 are elastic cords, such as "bungee" cords or the like. Elongated elastic members 22 are connected at one end, to a portion of the apparatus 10 on the first juncture end 12J of the first frame 12 or closer to the head end 1211 the first frame 12 than the first juncture end 12J. In the embodiment shown in FIG. 2, members 22 are fixed at one end to support structure 14S at locations intermediate the juncture end 12J and head end 1211 of frame 12. The opposite ends of elongated elastic members 22 are provided with connectors 22C configured and dimensioned to be releasably connected to carriage 18. Carriage 18 is provided with receptacles 18R (such as slots or the like) that are configured and dimensioned to releasably mate with connectors 22C. In the embodiment shown in FIG. 2C, each connector has a head portion 22H that is larger than a neck portion 22N connecting it to a body portion 22B which is also larger than the neck portion. To connect member 22 to carriage 18, a user inserted the head portion 2211 into the enlarged opening 18E of the receptacle 18R that it is longitudinally aligned with. The neck portion 18N is smaller than the enlarged opening 18E and allows neck portion 22N to slide therethrough, but does not allow either head portion 22H or body portion 22B to pass therethrough. To disconnect the member 22 from the carriage 18, the user slide the neck portion in a direction perpendicular (downward or upward) to the horizontal, thereby sliding neck portion 22N out of neck portion 18N and sliding head 2211 out of opening 18E. The amount of resistance applied to the carriage 18 can be varied according to the number of elastic members 22 connected thereto. Although the embodiment of FIG. 2 is shown having three elastic member 22, this is only an embodiment of the present invention, and the number of elastic members provided on apparatus 10 may vary, i.e., have less than three or more than three elastic members 22.

Foldable legs 24 are connected to frames 12, 16. In the extended configuration shown in FIG. 1A, legs 24 elevate the remainder of the apparatus above the floor by fourteen inches. When legs 24 are in the folded configuration, e.g., see FIG. 5A, the remainder of the apparatus is supported by frame posts 26 being 3 inches to the floor. The purpose for the extended leg 24 configuration in FIG. 1A is for the injured or physically debilitated user who cannot easily descend to the height of the apparatus when legs 24 are in the folded configuration, e.g., see FIG. 5A.

A foot bar assembly 30 is adjustably mounted to carriage 18. Foot bar assembly includes a pair of riser arms 32 pivotally mounted to opposite sides of carriage 18 and a cross bar 34 interconnecting the opposite ends of riser arms 32 that are not attached to carriage 18, as shown in FIG. 1A. Optionally, cross bar 34 may be padded, as shown. Foot bar assembly can be variably rotatably positioned so as to vary the angle 36 between the carriage 18 and the riser arms 32. This has the effect of increasing or decreasing the distance of cross-bar 34 from the head end 12H of frame 12, as well as increasing or decreasing the height of cross bar 34 relative to carriage 18. FIG. 1A shows one of the operative positions of foot bar assembly 30, positioned so that an exercise user lying on fixed body support 14 can press the user's feet against cross bar 34 and apply force to move carriage 18 in a direction away form the head end 12H.

Figure 3:
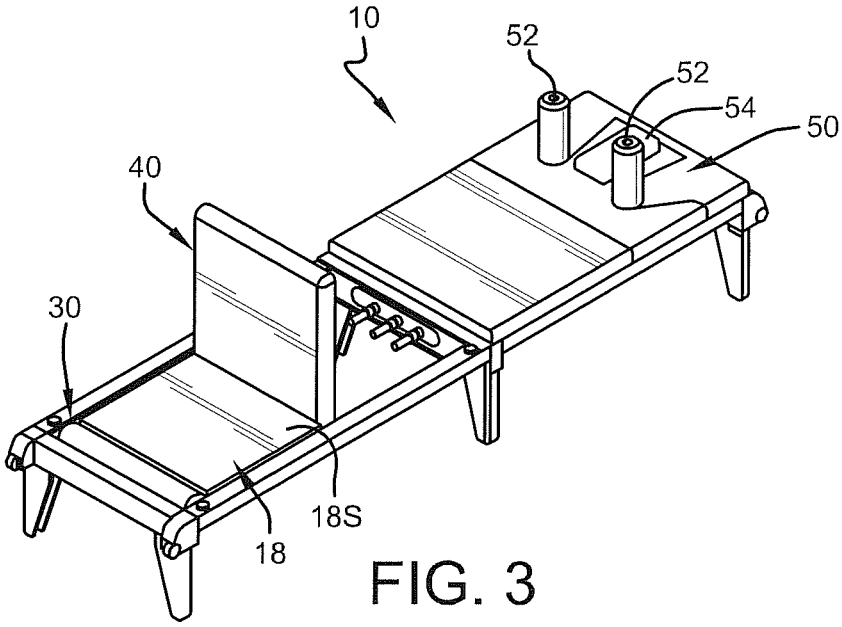
FIG. 3 is a perspective view of the present invention.
Figure 4:
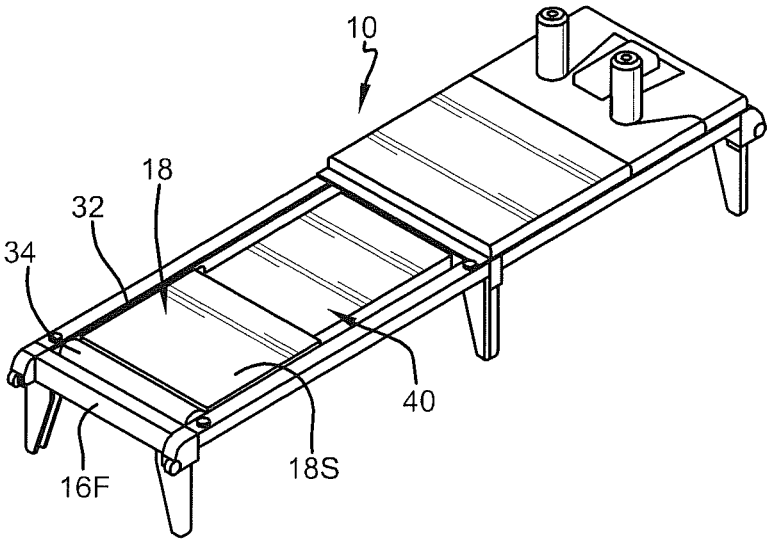
FIG. 4 is a perspective view of the present invention.

In addition to various operative positions that the foot bar assembly 30 can be fixed in, foot bar assembly can also be rotated towards the foot end 16F of frame 16 and stowed in a position where the tops surfaces of the foot bar assembly do not extend above the plane of the top surface 18S of carriage 18, as shown in FIGS. 3-4.

Additionally, a foot board 40 is provided on carriage 18. Foot board 40 includes a rigid, planar material, such as a board, steel, aluminum or other material designed to withstand the pushing forces applied to it by a user's foot or feet, while doing exercises wherein the force applied moves the carriage 18 against the resistance of elongated elastic members 22. Optionally, foot board 40 is padded on the side shown in FIG. 1A, which face upwardly when foot board 40 is in its position on top of carriage 18 when foot bar assembly is in an operative position, see FIG. 1A.

FIG. 3 shows foot board 40 in a operative position, substantially perpendicular to the top surface 18S of carriage 18 (substantially vertical, relative to the horizontally extending carriage 18 and frame 16), and with foot bar assembly 30 in the stowed position. Foot board 40 may be fixed in the operative position shown in FIG. 3, by insertion of an end portion of the foot board 40 into a channel provided at end 18J of carriage 18. Alternatively, foot board 40 may be pivotally mounted to the end 18J of carriage 18, and may be configured to be positioned not only in the operative configuration shown where board 40 forms a ninety degree angle with carriage 18.

Additionally, foot board 40 can be stowed adjacent carriage 18 in a stowed position shown in FIG. 4, wherein no portion of foot board 40 extends above the plane of top surface 18S of carriage 18.

Figure 5A:
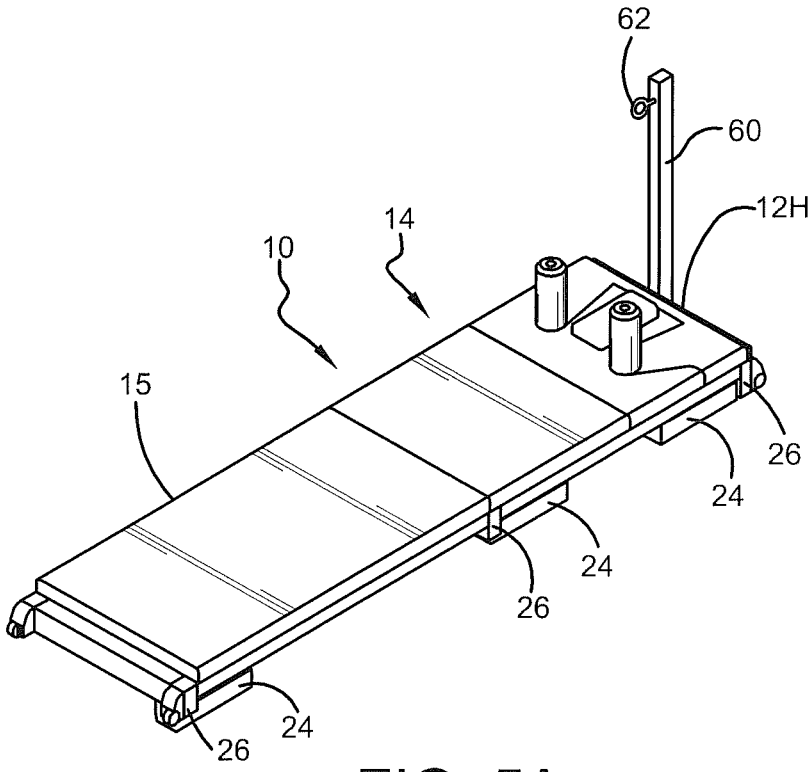
FIG. 5A is a perspective view of the present invention.
Figure 5B:
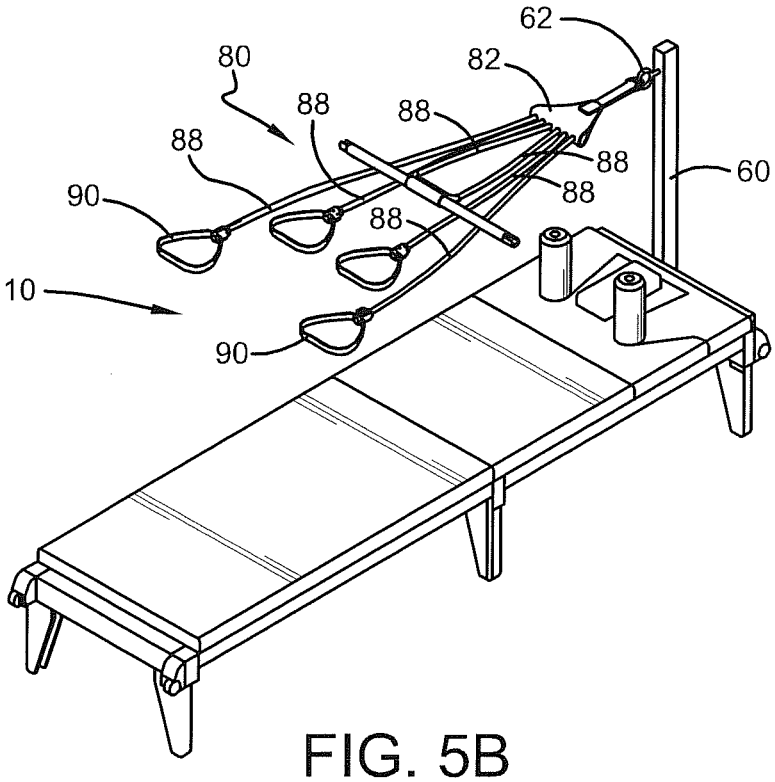
FIG. 5B is a side view of the present invention.
Figure 5C:
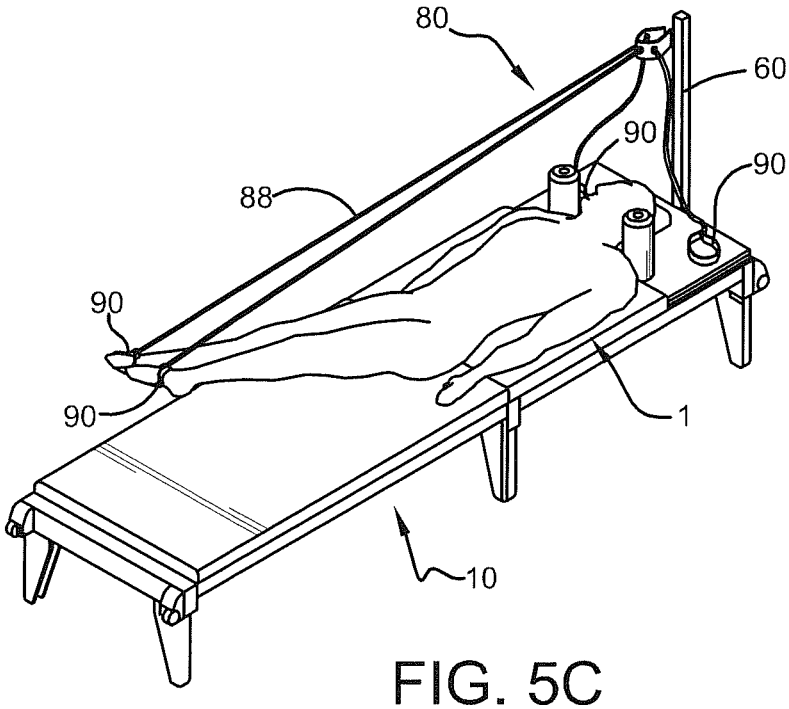
FIG. 5C is a perspective view of the present invention showing the present invention in use.
Figure 6:
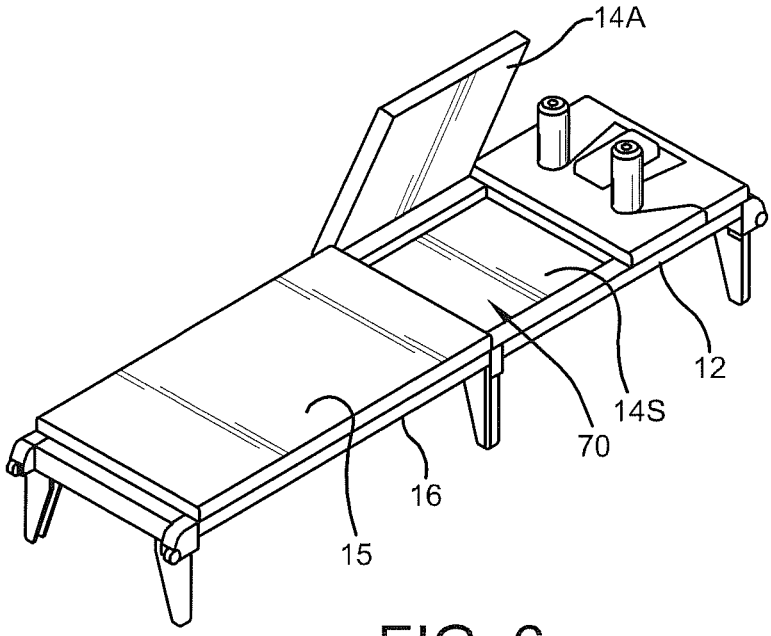
FIG. 6 is a perspective view of the present invention.

With foot board 40 in the stowed position shown in FIG. 4 and foot bar assembly 30 in the stowed position shown in FIG. 4, this allows the apparatus 10 to be fitted with a flat pad 15 as shown in FIGS. 5-6. Flat pad 15 is configured and dimensioned to overlie the second frame 16, carriage 18, foot bar assembly 30 and foot board 40 and to provide a level extension of fixed body support 14 that is also designed to support the full weight of a user. Flat pad 15 can be fixed relative to frame 16 by providing pegs (not shown) spaced appropriately to fit in holes (not shown) in the top of frame 16, for example, or by using clamps or other mechanical expedients. Further alternatively, frame 16 can be provided with upwardly extending flanges (not shown) around the perimeter thereof into which flat pad 15 fits to be confined and contained thereby.

Figure 3A:
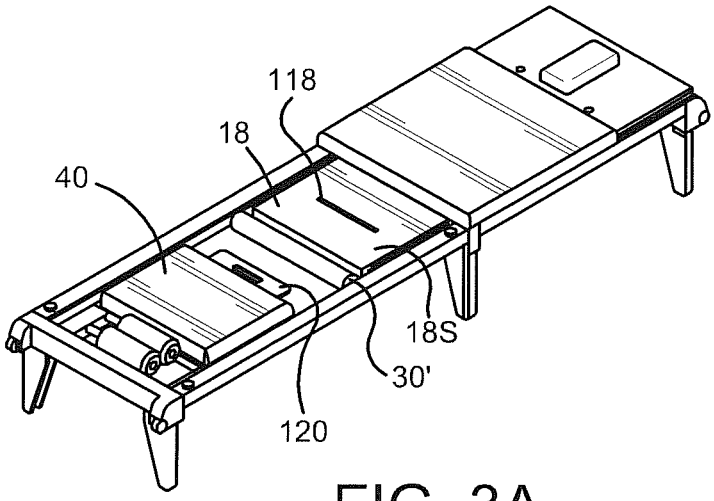
FIG. 3A is a perspective view of another embodiment of the present invention.
Figure 4A:
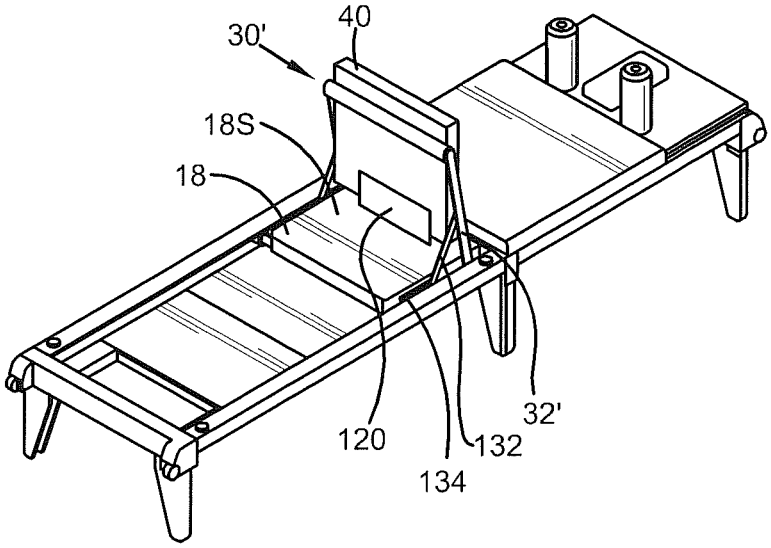
FIG. 4A is a perspective view of another embodiment of the present invention.

FIGS. 3A and 4A illustrate another embodiment of the foot board 40. In this embodiment, a support link 132 is utilized to interconnect riser arm 32' with grooves 134 of either side of the carriage 18. The riser arm 32' is rotationally attached to the carriage 18 and enables the foot bar assembly 30 to easily rotate from a use position shown in FIG. 4A to a stowed position in FIG. 3A. Further, the foot board 40 is selectively attachable to the carriage 18 through flange 120. Flange 120 of the foot board 40 is selectively insertable within carriage slot 118.

A head end assembly 50 includes a pair of spaced shoulder stops 52 and a head rest 54 adjustably mounted to the fixed body support 14. Shoulder stops 52 and head rest 54 are attached to head end assembly frame 56. Head end assembly frame 56 is slidably adjustable along frame 12 to adjust the distance of the assembly 50 from the head end 12H of frame 12. This is useful to adjust for variations in height (and especially, torso height) of the exercise user. In the embodiment shown in FIG. 1A, a series of through holes 58 are provided on both sides of frame 12 at corresponding distances from the head end 12H. The user can then align through holes in assembly 50 with a pair of through holes 58 in frame 12 where assembly 50 is at the desired distance from head end 12H, and locking pins 59 are then inserted through the holes of the assembly and the selected through holes 58 of the frame 12 to set the desired positioning of the assembly 50 to fit the current exercise user. The assembly 50 positioning can be reset as needed. Additionally, the assembly 50 can be completely removed by simply removing the locking pins 59 and sliding the assembly 50 off the head end 12H of frame 12, which can be advantageous for stacking multiple apparatuses 10, for example.

Figure 1B:
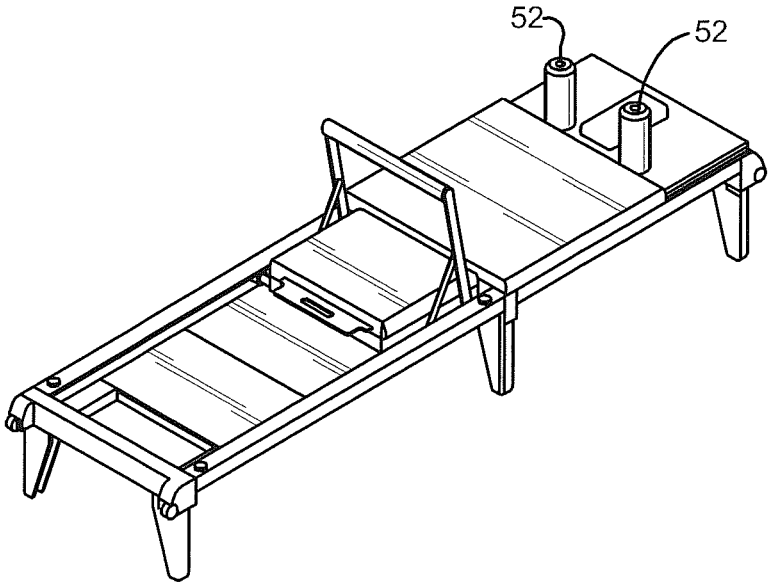
FIG. 1B is a perspective view of another embodiment of the present invention.

With reference to FIG. 1B, another embodiment of the present invention is shown. The shoulder stops 52 are attached to the head end assembly frame 56 via holes 102. Further the shoulder stops 52 may be selectively removable and stored in a storage compartment 70A. In this embodiment, the shoulder stops 52 do not move in unison with the head rest 54 and are not adjustable.

In order to perform additional exercises that do not include use of the foot bar assembly 30 or foot board 40 a post 60 is removably mountable to the head end 12H of frame 12, preferably in a location midway between the sides of the frame 12. Post 60 extends vertically above the frame 12 and support surface of fixed body support 14, see FIG. 5A. Post 60 includes at least one fixture 62 to which at least one elongated elastic member 88 can be fixed either directly or via a yoke or housing. Elongated elastic members may be springs, elastic straps, etc., but preferably elastic cords are used.

A portion 14A of fixed body support 14 opens to reveal a storage compartment 70 therebeneath, as shown in FIG. 6. Portion 14A may be hinged to frame 12 to allow it to swing open like a door, as shown in FIG. 6, or may be removed vertically from the frame 12 and thereby function more like a cap. In either case, portion 14A is still a fixed body support 14 when in the closed position showing in FIGS. 1A and 5A and does not move during exercises, but supports the user in a fixed position. Storage compartment may be used to store elongated elastic members and/or post 60 when not in use, for example. The bottom of storage compartment is formed by structural support 148.

Figure 6A:
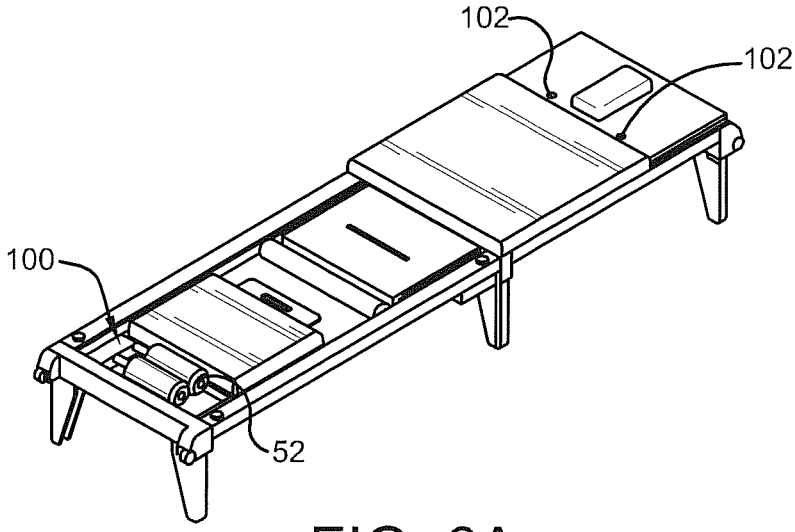
FIG. 6A is a perspective view of another embodiment of the present invention.

With respect to FIG. 6A, another embodiment of the present invention is shown. In this embodiment, the storage compartment 70A is found at the foot end 16F of the frame 16. As shown, the shoulder stops 52 may be removed from holes 102 and stored in the storage compartment 70A. In this embodiment, the flat pad 15 may be selectively removable for the user to gain access to the storage compartment 70A.

FIGS. 5B-5C illustrate an embodiment in which a resistance assembly 80 is provided in which elongated elastic members 88 are elastic cords that are passed through yoke 82, and yoke 82 is connected to fixture 62 using a snap hook or a small closeable c-clamp, or other equivalent mechanical connecting expedient. At least one actuator 90 is provided on an end portion of elongated elastic member 88. Actuator 90 is configured to be engaged by a hand or foot of the exercise participant 1 to apply force therethrough to perform an exercise. In the embodiment shown in FIGS. 5B-5C, two elongated elastic member 88 are looped through grommeted openings in yoke 82. Both members 88 are provided with an actuator 90 at each end of the member 88. One elongated elastic member 88 is substantially longer than the other elongated elastic member 88 (see FIG. 5C) with the relatively longer member 88 being configured and dimensioned for use by the feet of the user 1 and with the relatively shorter member 88 being configured and dimensioned for use by the hands of the user. In the embodiment shown in FIGS. 5B-5C, actuators 90 are looped, reinforced straps designed to receive a foot or hand into the loop and to support forces generated during performance of exercises.

Figure 7A:
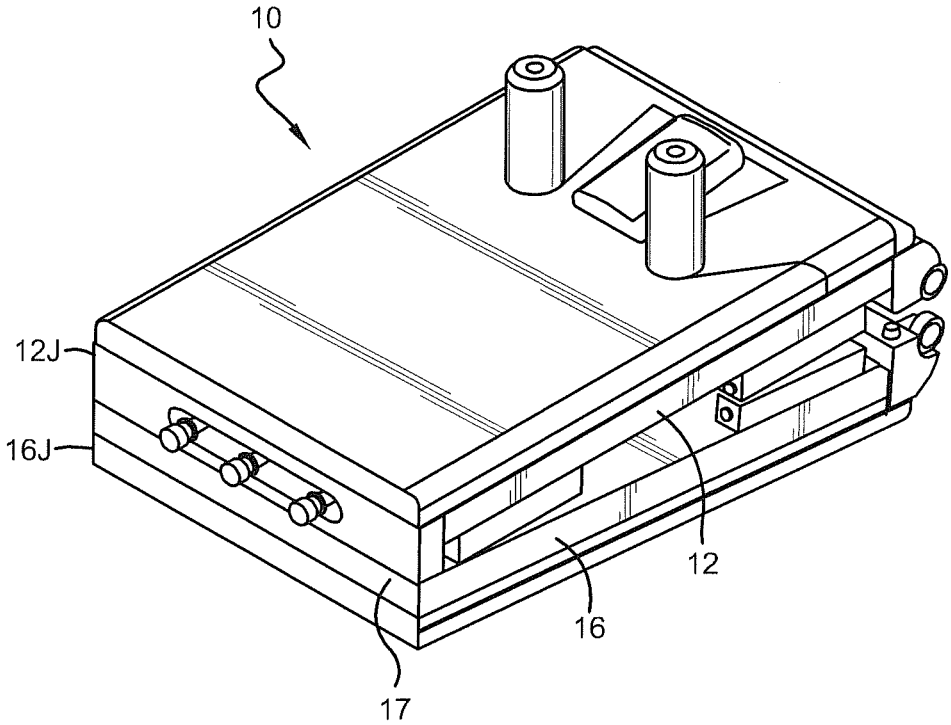
FIG. 7A is a perspective view of the present invention in a stowed position.
Figure 7B:
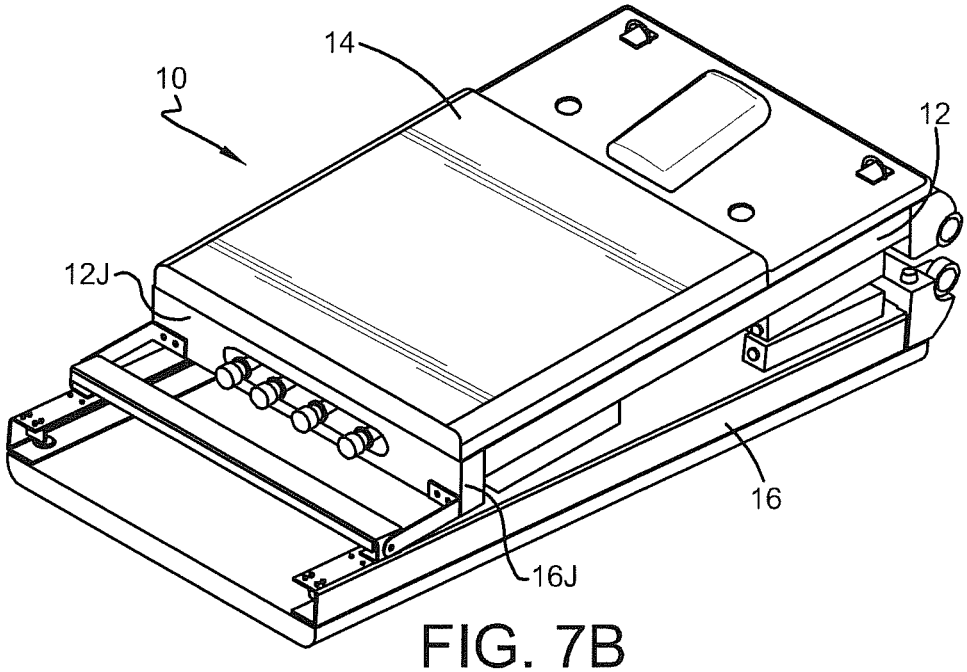
FIG. 7B is a perspective view of another embodiment of the present invention in the stowed position.

Apparatus 10 is foldable, such that first frame 12 can be stacked on second frame 16 as shown in FIGS. 7A and 7B. In the embodiment shown in FIGS. 2 and 7, a hinge 17 interconnects first juncture end 12J and second juncture end 16J to allow frame 16 to be folded under frame 12, while maintaining alignment of the frames 12, 16 for a neat, compact storage or transportation configuration, as shown in FIGS. 7A and 7B. Alternatively, if assembly 50 is removed from fixed body support 14, frame 16 can be stacked on top of frame 12, (i.e., allows inverted configuration, relative to what is shown in FIG. 7).

Figure 8:
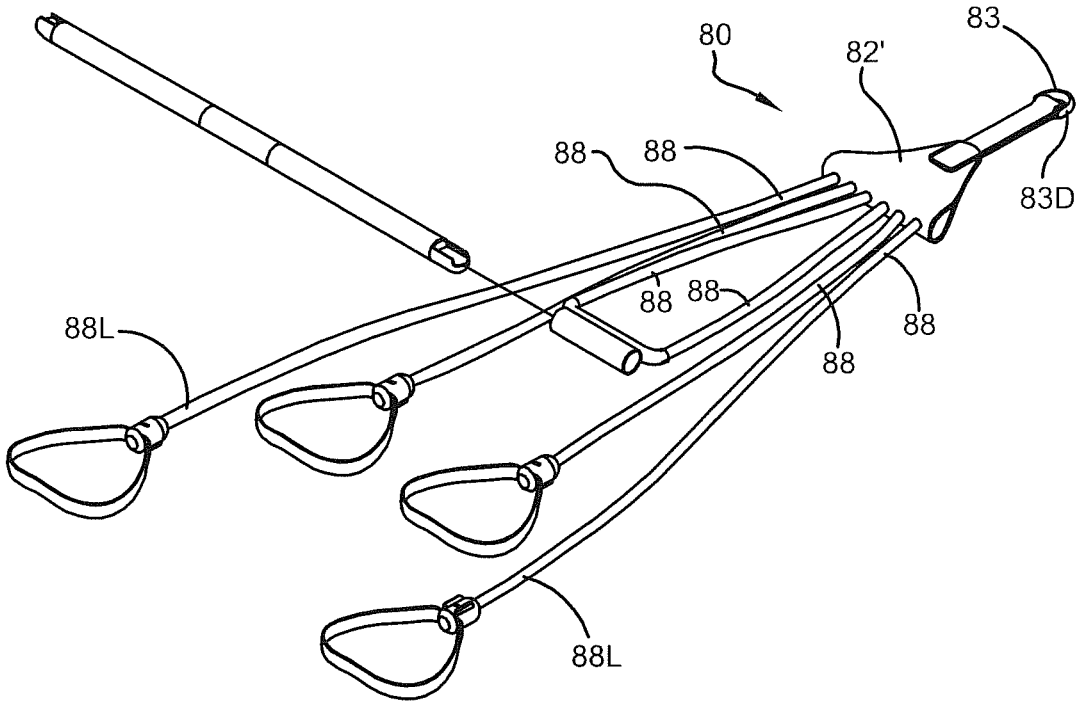
FIG. 8 is perspective view of the present invention illustrating an elastic cords device.

FIGS. 5B and 8 show a perspective view of another embodiment of a resistance assembly 80' according to the present invention. Assembly 80 includes a plurality of elongated elastic members 88 fixed to a housing 82' that has a fixation connector 83 extending away from the elongated elastic members and configured to be fixed to fixture 62 on post 60. In the embodiment shown, fixation connector 83 includes a D-ring 83D at an end thereof. Alternatively, other mechanical expedients may be substituted for D-ring 83D for use in connecting to fixture 62. In this embodiment, elongated elastic members 88 do not loop through housing 82' and therefore have only one actuator at most. In the embodiment shown in FIG. 8, five elongated elastic members 88 are fixed to housing 82'. It is noted that this embodiment is not limited to use of five elastic members 88, as more or fewer may be implemented. The four outermost elongated elastic members are fixed at one end to housing 82' and are each provided with an actuator 90 at an opposite end thereof. The central most elongated elastic member 88L is fixed at both ends to housing 82' and therefore forms a loop having no actuator 90. It is further noted that assembly 80' is not limited to this combination/arrangement of elongated elastic members, as various other arrangements may be provided. For example, assembly 80' could be provided with no looped elastic members 88L or more than one looped elastic member 88L.

Figures 9A, 9B, 9C:
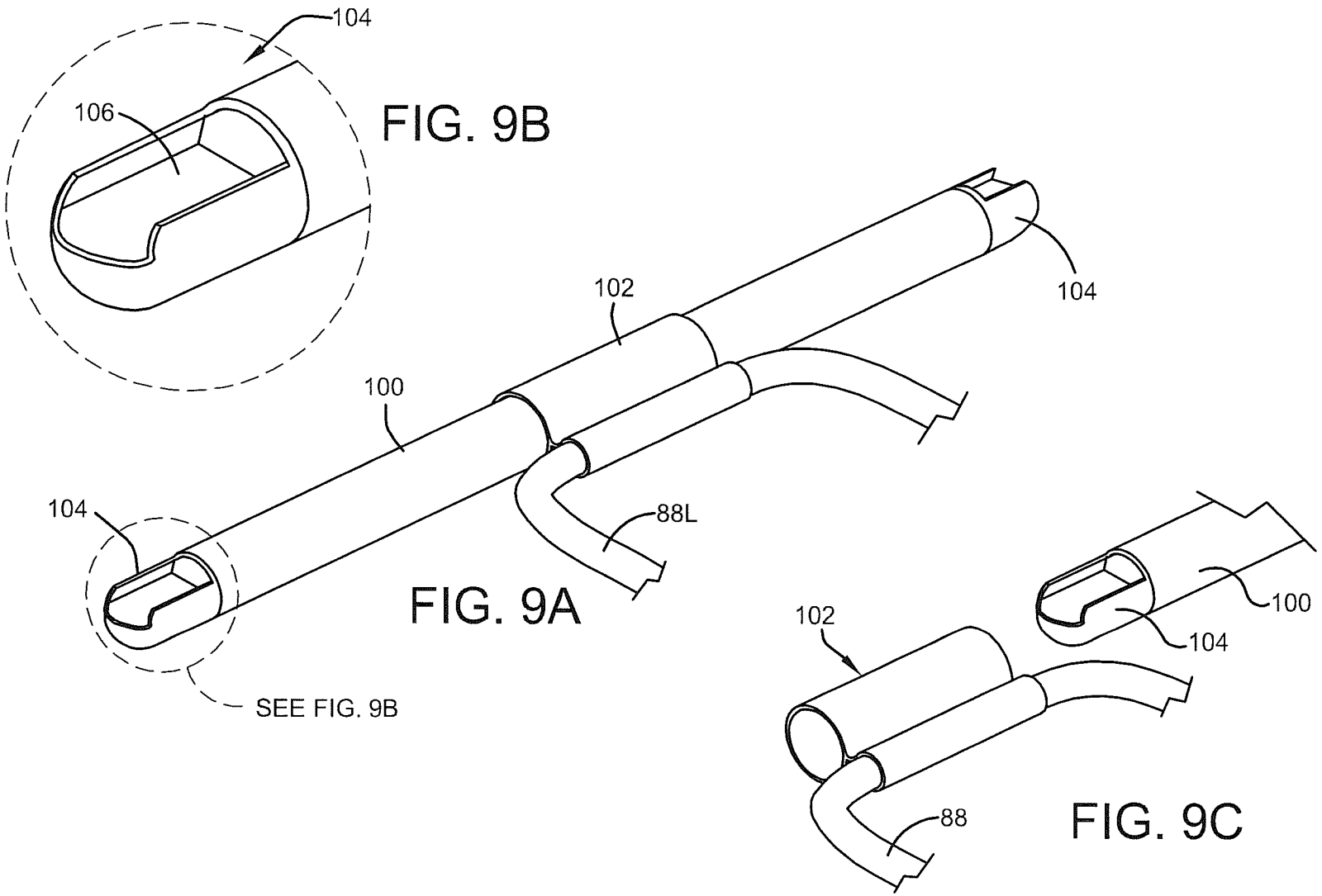
FIGS. 9A-9C are enlarged perspective views of portions of the present invention.

FIG. 9A illustrates releasable attachment of a rigid elongated member 100 to a looped elongate elastic member 88L for preparation of performing an exercise therewith. In this embodiment, looped elongate elastic member 88L is provided with a receptor 102 for temporarily receiving rigid elongated member 100 therethrough (see FIGS. 9C and 9A), to connect member 100 to elastic member 88L so that an exercise participant can grasp the handle and apply force against the elastic member 88L and fixed object (such as post 60) to perform an exercise. In this embodiment, receptor 102 is a sleeve (made of leather, webbing, metal or other material having sufficient strength to transfer forces from 100 to 88L without failing), and rigid elongated member is a rigid tube, such as steel, stainless steel or the like, having sufficient strength and rigidity to apply forces to the elastic member 88L without bending or otherwise failing. End caps 104 may be metal or rigid polymer. The center portion of elongated member 100 may optionally be provided with a polymer coating to increase the diameter thereof and/or increase friction between the member 100 and sleeve 102 to help maintain the elongated member 100 in a centered position during use in transferring forces to member 88L.

At least one of the end caps 104 is formed with a mating receptor 106 configured and dimensioned to mate with a receptor on an actuator 90 as described in further detail below. In the embodiment shown in FIG. 9B, mating receptor 106 is an open ended channel that opens to the free end of the end cap 104.

Figures 10A, 10B, 10C, 10D:
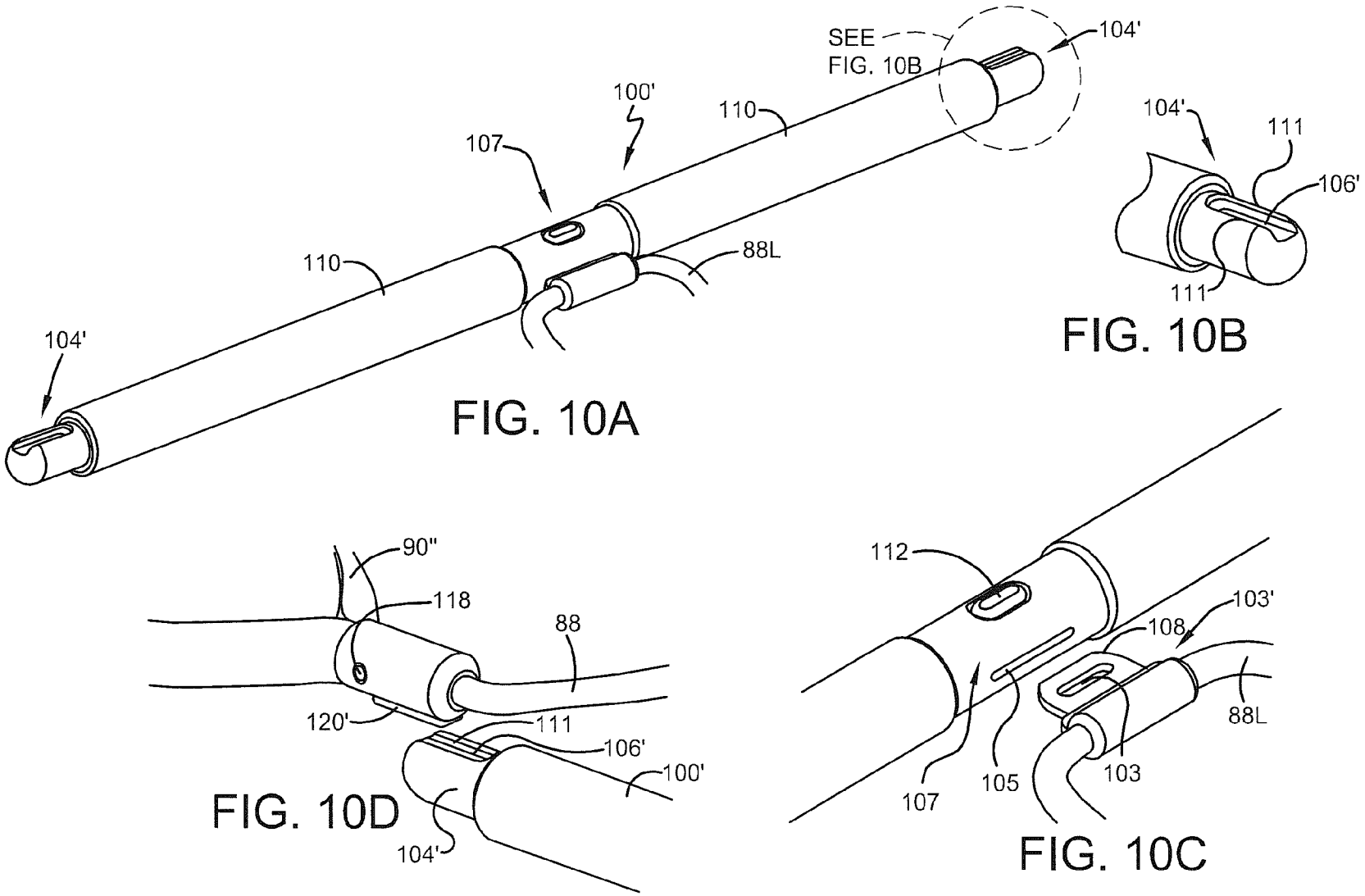
FIGS. 10A-10D are enlarged perspective views of features of the present invention.

FIG. 10A illustrates releasable attachment of another embodiment of a rigid elongated member 100' to a looped elongate elastic member 88L for preparation of performing an exercise therewith. In this embodiment, looped elongate elastic member 88L is provided with a receptor 102' for temporarily mating with rigid elongated member 100' (see FIGS. 10C and 10A), to connect member 100' to elastic member 88L so that an exercise participant can grasp the handle and apply force against the elastic member 88L and fixed object (such as post 60) to perform an exercise. In this embodiment, receptor 102' is a slotted tongue 108 receives a spring loaded locking bar therethrough? upon insertion of tongue 108 into slot 105, thereby locking the rigid elongated member 100' to receptor 102' which is in turn fixed to 88L midway between its fixed ends. To release the rigid elongated member 100' from attachment to elastic member 88L, the user presses button 112 which retracts the spring loaded locking bar, thereby allowing tongue 108 to be withdrawn from slot 105.

Rigid elongated member 100' in the embodiment of FIGS. 10A-10D is a rigid tube made of steel, stainless steel, or the like, having sufficient strength and rigidity to apply forces to the elastic member 88L without bending or otherwise failing. Foam grips 110 may be applied to cover the rigid tube on both sides of mechanism 107, to provide a softer, yet surer grip for the user's hands. End caps 104' may be metal or, rigid polymer. At least one of the end caps 104' is formed with a mating receptor 106' configured and dimensioned to mate with a receptor on an actuator 90 as described in further detail below. In the embodiment shown in FIG. 10B, mating receptor 106' is an open ended channel that opens to the free end of the end cap 104' with lips formed by undercutting the channel 106'.

FIG. 10D illustrates use of rigid elongated member 100' to facilitate engagement of an actuator 90 by the foot of a user in order to perform an exercise requiring engagement of an actuator 90 by the foot. Elongated elastic member 88 is provided with an actuator 90" that is configured and dimensioned for engagement by a foot of a user. With rigid elongate member 100' being detached from receptor 102' and elongated elastic member 88L, the exercise participant (e.g., user 1) can use the rigid elongated member 100' to engage a receptor 120' provided on the end of the elongated elastic member 88 and/or actuator 90" attached thereto, as shown in FIG. 10D. The receptor 120' is keyed to mating receptor 106' of end cap 104'. Accordingly, the user can slide mating receptor 106' over receptor 120' and then push (by hand) with rigid elongated member 100' to extend the elastic member 88 so as to move the actuator 90" closer to the foot of the user that is to be engaged in the actuator 90". This feature can be extremely useful for rehabilitating patients with limited range of motion in their knees and/or hips, or with other disabilities that make it difficult to bring their foot up far enough to engaged the actuator when elastic member has not been stretched. Once the user has engaged the foot in the actuator, the rigid elongated member can then be detached by pulling it back to slide mating receptor 106' off of receptor 120'.

Figure 11A:
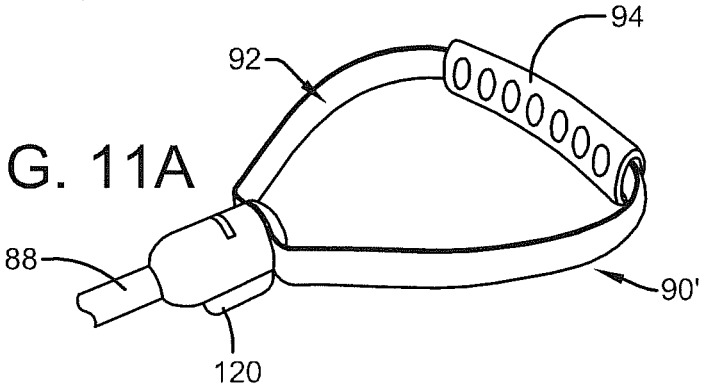
FIGS. 11A-11D are enlarged perspective views of features of the present invention.
Figure 11B:
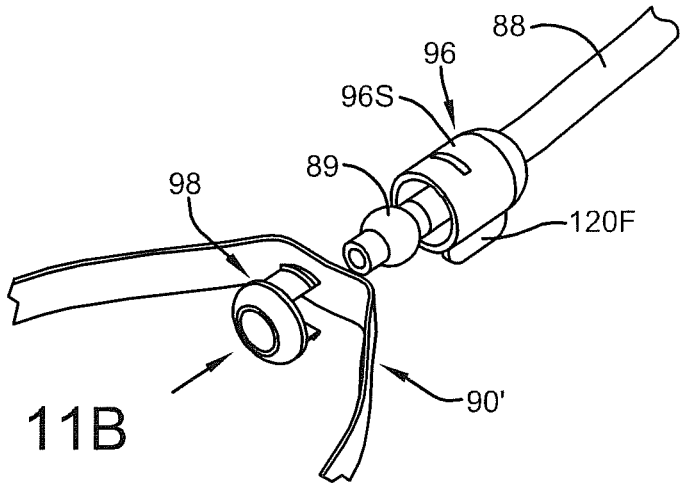

FIG. 11A is a partial view of an elongated elastic member 88 provided with an actuator 90' and having a receptor 120 configured and dimensioned to mate with the mating receptor 106 described with regard to the embodiment in FIGS. 9A-9B. It should be noted here that member 100 is not limited to use of mating receptor 106, but could alternatively use mating receptor 106'. Likewise none of the actuators 90, 90', 90", 90"' described are limited to the type of receptor 120, 120' shown as described, as these can be mixed and matched. In FIG. 11A, actuator 90' is formed of strap webbing 92, such as cotton or nylon webbing or other woven, knitted or fiber reinforced material having sufficient tensile strength to withstand the forces applied to it when performing exercises. A rubber (or other high friction polymer) sleeve 94 may be fixed to at least a portion of the actuator 90' most probable to be engaged by the hand or foot, to increase friction and reduce risk of slipping.

In this embodiment, actuator 90' is fixed to the end portion of elongated elastic member 88 by sliding a housing body 96 (injection molded plastic or machined metal) over the member 88. An anchor 89 is provided near the free end of elastic member 88 to prevent housing body 96 from being able to slide off of elastic member 88. A cap 98 that straddles the strap 92 of actuator 90' is then snap fitted into slots 96S of housing body 96, thereby fixing actuator 90' to elastic member 88 (see FIG. 11B).

Figure 11C:
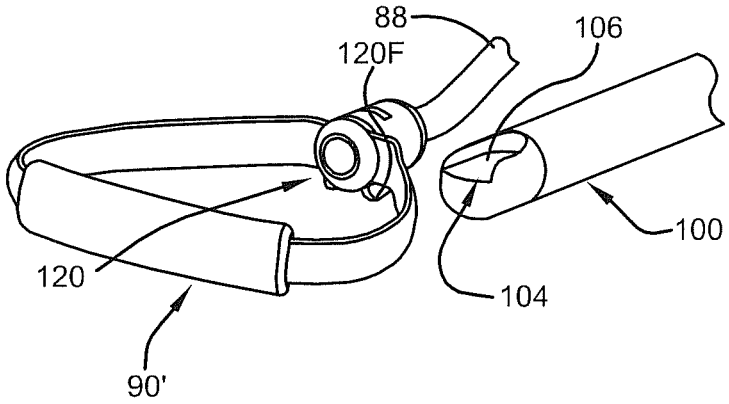
Figure 11D:
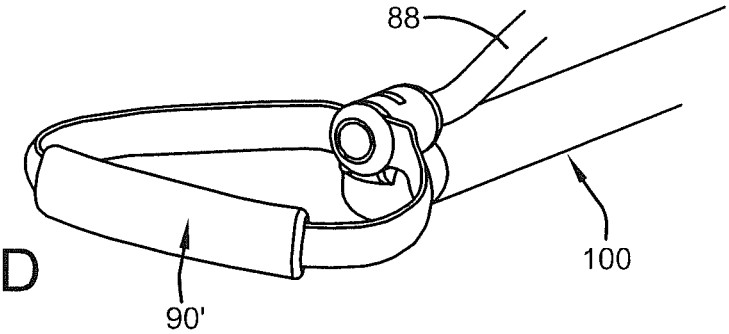

FIG. 11C illustrates use of rigid elongated member 100 to facilitate engagement of an actuator 90' by the foot of a user in order to perform an exercise requiring engagement of an actuator 90' by the foot. Elongated elastic member 88 is provided with an actuator 90' that is configured and dimensioned for engagement by a foot of a user. With rigid elongate member 100 being detached from receptor 102 and elongated elastic member 88L, the exercise participant (e.g., user 1) can use the rigid elongated member 100 to engage a receptor 120 provided on the end of the elongated elastic member 88 and/or actuator 90' attached thereto, as shown in FIGS. 11C-11D. The receptor 120 is keyed to mating receptor 106 of end cap 104. Accordingly, the user can slide mating receptor 106 over receptor 120 and then push (by hand) with rigid elongated member 100 to extend the elastic member 88 so as to move the actuator 90' closer to the foot of the user that is to be engaged in the actuator 90'. This feature can be extremely useful for rehabilitating patients with limited range of motion in their knees and/or hips, or with other disabilities that make it difficult to bring their foot up far enough to engaged the actuator when elastic member has not been stretched. Once the user has engaged the foot in the actuator, the rigid elongated member can then be detached by pulling it back to slide mating receptor 106 off of receptor 120

Figure 12A:
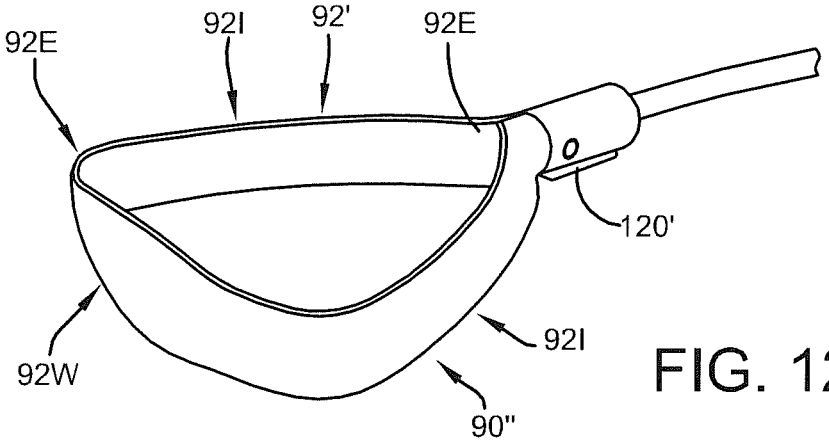
FIGS. 12A-12C are perspective views of features of the present invention.
Figure 12B:
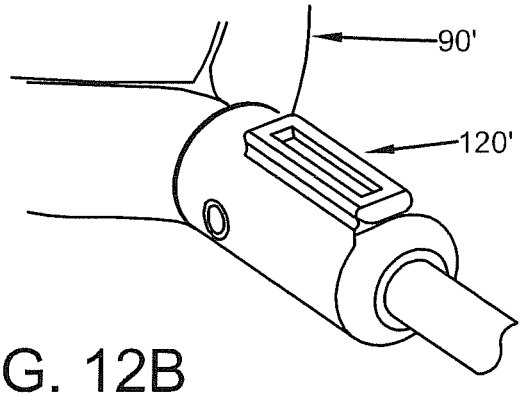

FIG. 12A is a partial view of an elongate elastic member 88 provided with an actuator 90" and having a receptor 120' (see FIG. 12B) configured and dimensioned to mate with the mating receptor 106' as described above with regard to FIG. 10D. Actuator 90" is formed of a rubberized strap webbing 92' (or other relatively soft, high friction, tough polymer coating a strap), and is relatively thicker at end portions 92E and thinner in intermediate portions 921. End section 92W is wider and flatter than the remainder of the actuator 90" to provide good arch support to the foot of a user.

Figure 12C:
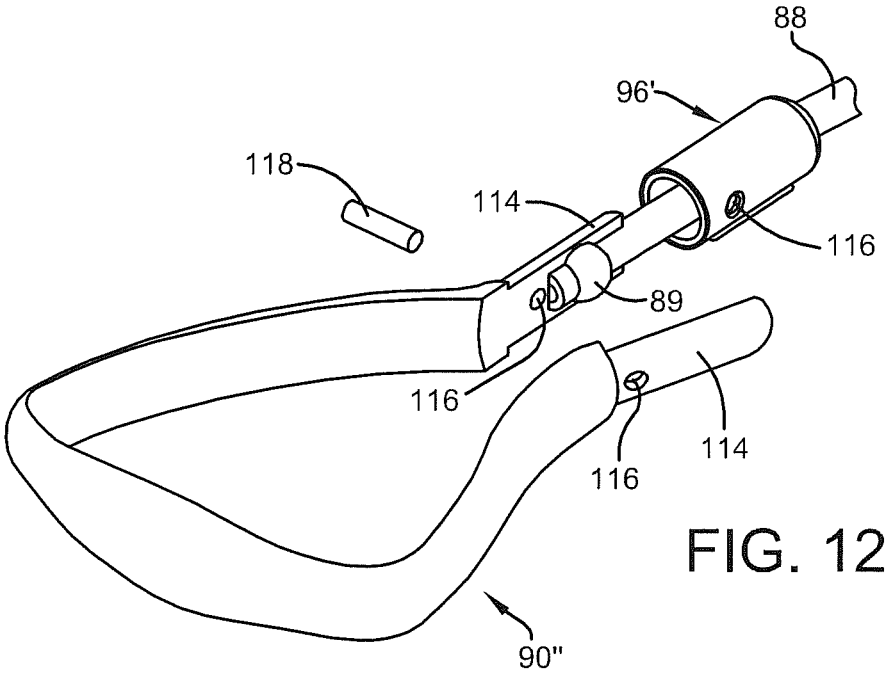

In this embodiment, actuator 90" is fixed to the end portion of elongated elastic member 88 by sliding a housing body 96' (injection molded plastic or machined metal) over the member 88. An anchor 89 is provided near the free end of elastic member 88 to prevent housing body 96' from being able to slide off of elastic member 88. Rigid connector halves 114 of actuator 90" are form fitted to anchor 89 so that, when connected together, they are prevented from slipping off of anchor 89. Also, the outside profile of the halves 114 when connected together is configured and dimensioned to slide into housing body 96'. Each of housing body 96' and rigid connector halves 114 have through holes 116 that align when halves 114 are fitted over anchor 89 and housing body 96' is slid over halves 114, to receive a pin 118 that is press fit into the holes 116, thereby fixing the actuator 90" to the elastic member 88 as shown in FIGS. 12C and 10D.

Figure 13:
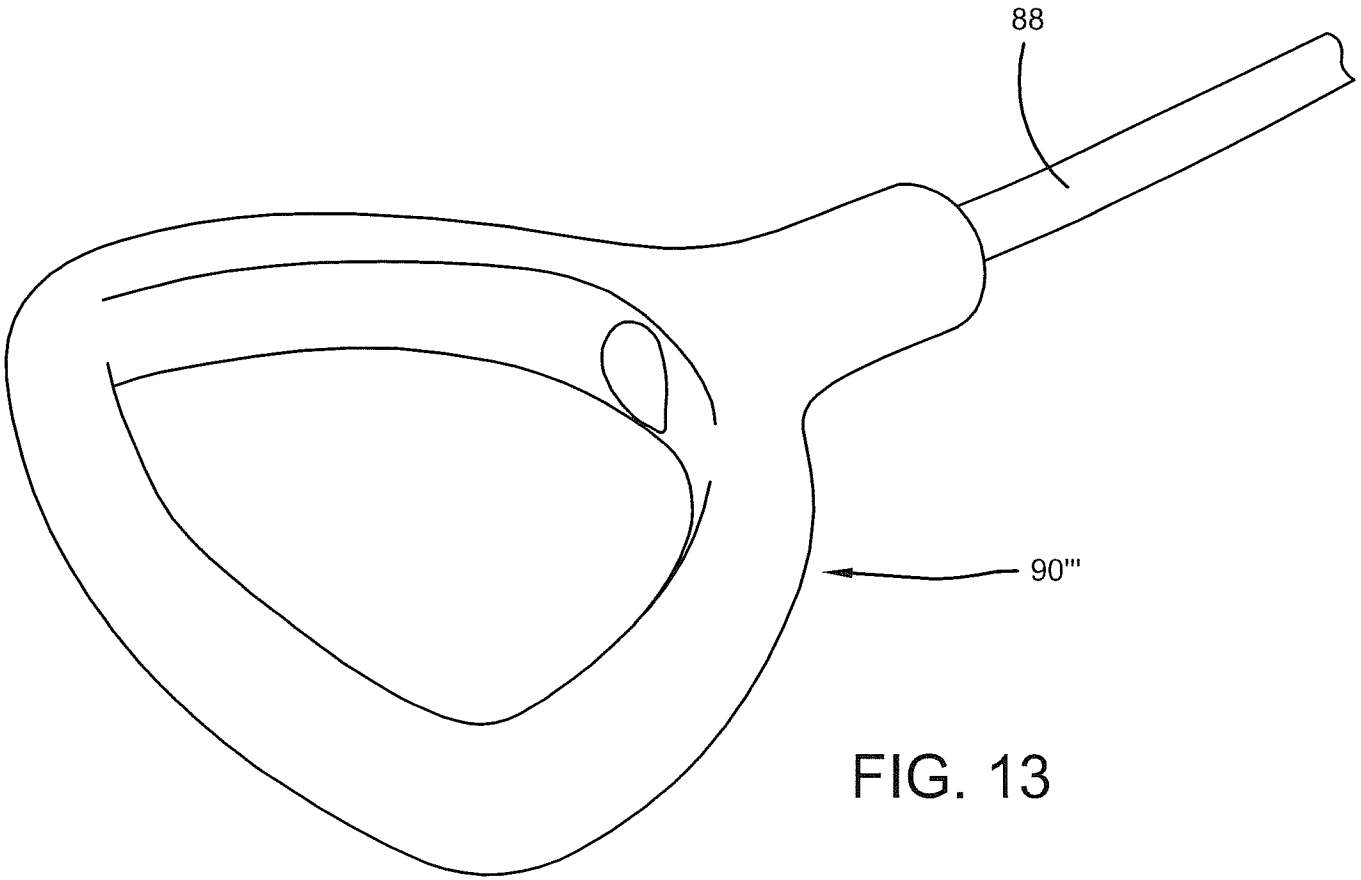
FIG. 13 is an enlarged perspective view of another feature of the present invention.
Figure 14A:
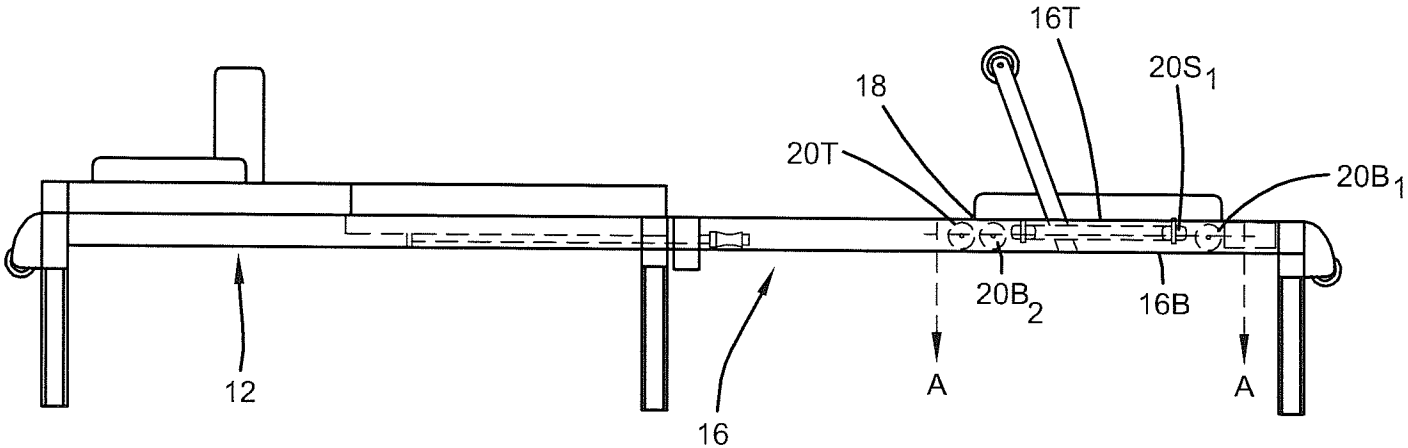
FIG. 14A is side view of another embodiment of the present invention.
Figure 14B:
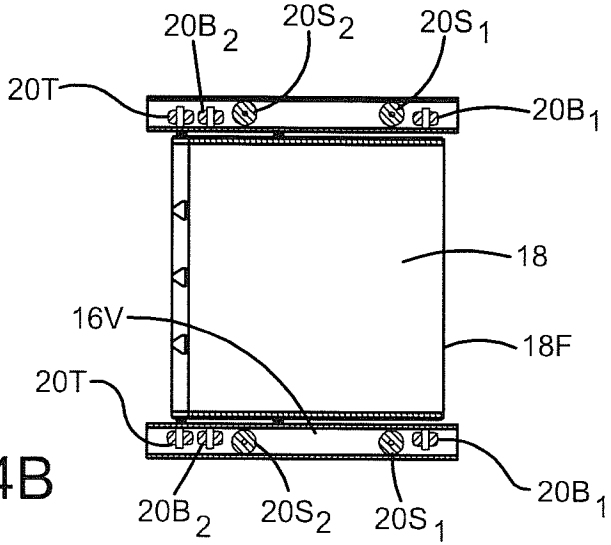
FIG. 14B is a cross section of FIG. 14A taken along section line A-A.
Figure 14C:
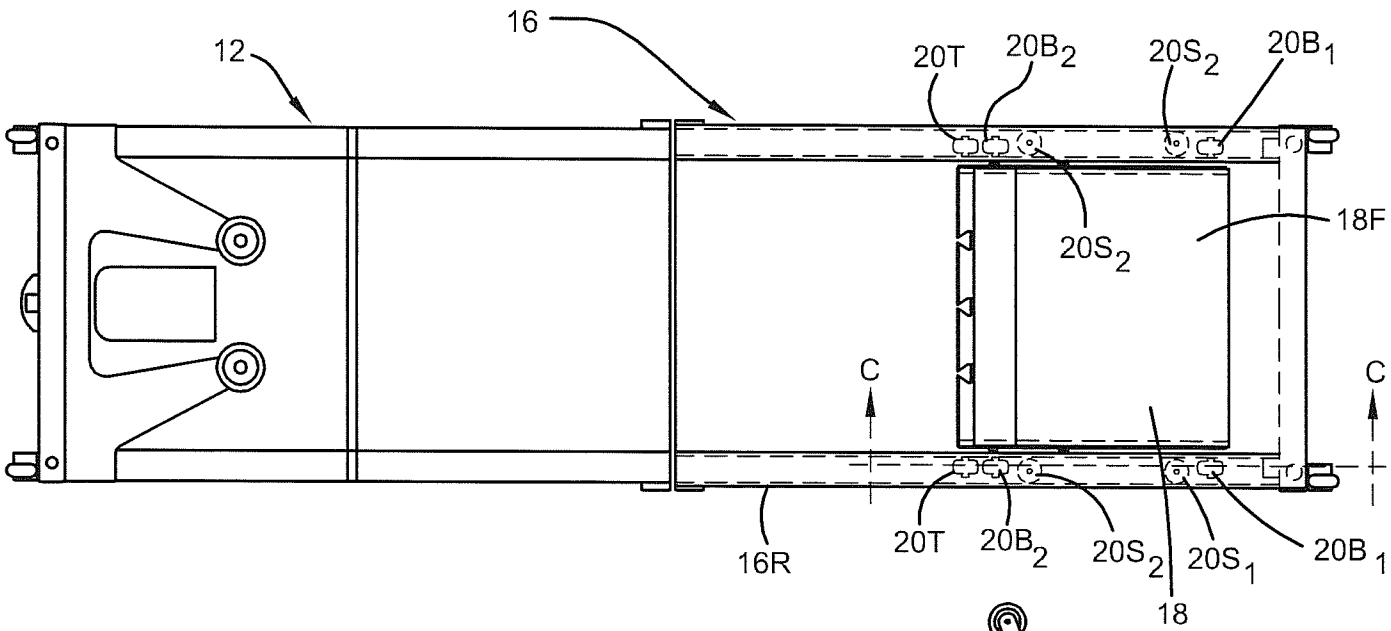
FIG. 14C is a top view of the present invention shown in FIG. 14A.
Figure 14D:
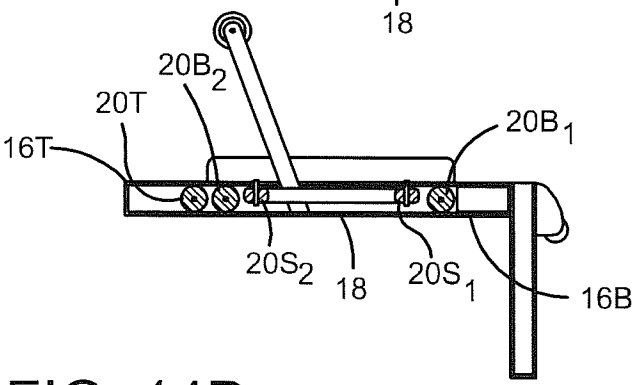
FIG. 14D is a cross section of FIG. 14C taken along section line C-C.

FIG. 13 illustrates another embodiment of an actuator 90' fixed to elastic member 88, in which actuator 90' is formed by structural foam that is injection molded.

While the present invention has been described with reference to the specific embodiments thereof, it should be understood by those skilled in the art that various changes may be made and equivalents may be substituted without departing from the true spirit and scope of the invention. In addition, many modifications may be made to adapt a particular situation, material, composition of matter, process, process step or steps, to the objective, spirit and scope of the present invention. All such modifications are intended to be within the scope of the claims appended hereto.

What is claimed is:

1. An exercise apparatus comprising:

a first frame, said first frame being generally rectangular and having a head end and a first juncture end;

a fixed body support fixed on said first frame and configured and dimensioned to support a-torso of an exercise participant;

a second frame, said second frame being generally rectangular and comprising a second juncture end, a foot end and a pair of rail members extending along opposite sides of said second frame, said second frame disposed adjacent to, and in generally a same plane as, said first frame during operation of said apparatus;

a carriage mounted on said second frame for and configured to move along said rail members between said second juncture end and said foot end, said carriage comprising:

one or more receptacles, disposed at a third juncture end, and respectively configured to selectively receive a base resistance element engaged with said first frame; and a foot bar assembly configured to be adjustable to accommodate one or more operation positions; and a post selectively mounted to said head end of said first frame, said post extending orthogonal to the plane of said first frame during operation, said post configured to selectively receive one or more elongated resistance elements.

2. The apparatus of claim 1, wherein respective rail members comprise a substantially C-shaped channel in cross section, and are configured to receive one or more wheels engaged with said carriage to provide support and alignment for the carriage during operation, and to mitigate undesired tilting of said carriage during operation.

3. The apparatus of claim 1, wherein said fixed body support has a first length, said carriage has a second length, and wherein said first length is greater than said second length.

4. The apparatus of claim 1, wherein said foot bar assembly is configured to be adjusted into a stowed position.

5. The apparatus of claim 1, wherein said base resistance element is disposed at an underside of said fixed body support, and is configured to extend between said carriage and a portion of said first frame closer to said head end of said first frame than said first juncture end.

6. The apparatus of claim 1, wherein said apparatus is foldable to stack said first frame on said second frame.

7. The apparatus of claim 1, further comprising a storage compartment beneath at least a portion of said fixed body support, wherein said at least a portion of said fixed body portion opens to provide access to said storage compartment and closes to a closed position used when supporting the exercise participant.

8. The apparatus of claim 1, further comprising: a pair of spaced shoulder stops and a head rest, wherein said head rest is adjustably mounted to said fixed body support.

9. The apparatus of claim 1, further comprising a foot board adjustably mounted to said carriage and positionable substantially vertically relative to said second frame.

10. The apparatus of claim 1, wherein said one or more elongated resistance elements selectively engaged with said post are configured to be utilized at a same time as said carriage to engage different muscle groups of a user during a same exercise unit.

11. The apparatus of claim 1, wherein said one or more elongated resistance elements respectively comprise at least one actuator provided on an end portion of said elongated resistance element and configured to be engaged by a hand or foot of said user.

12. The apparatus of claim 11, further comprising a yoke configured to connect said one or more elongated resistance elements to said post, wherein said respective one or more elongated resistance elements loops through an opening of said yoke, wherein a first actuator is engaged with a first end portion of a first elongated resistance element and wherein a second actuator is engaged with a second end portion of said first elongated resistance element.

13. The apparatus of claim 1, further comprising a flat pad configured and dimensioned to overlie said second frame and said carriage.

14. The apparatus of claim 1, further comprising:

a housing configured to be connected to said post;

a plurality of elongated elastic members, respectively comprising a first end and a second end;

at least a first end of each respective elastic members operably engaged with said housing; and at least one actuator operably engaged with a second end of at least one of said elongated elastic members.

15. The apparatus of claim 14, further comprising a receptor operably engaged with said second end of said at least one elongated elastic member; and a rigid elongated member comprising a mating receptor disposed at one end of said rigid elongated member; wherein said mating receptor is configured to be engaged with said receptor by a user for use in extending said at least one elongated elastic member to facilitate engagement of said actuator by a foot of said user.

16. The apparatus of claim 15, wherein one of said elongated elastic members comprises both of said first and second ends fixed to said housing; and a second receptor intermediate said first and second ends; wherein said rigid elongated member is configured to engage said second receptor at location intermediate of first and second ends of said rigid elongated member.

17. An exercise device, comprising:

a carriage mounted on a second frame of an exercise device comprising one or more receptacles configured to engage a corresponding base resistance element disposed on a first frame, said second frame comprising a juncture end, a foot end and a pair of rail members extending along opposite sides of said second frame;

wherein said second frame is operably engaged in a same plane with said first frame, said first frame comprising a fixed body support fixedly engaged with said first frame and configured and dimensioned to support a torso of an exercise participant;

wherein said carriage is configured to move along said rail members between said juncture end and said foot end;

a foot bar assembly disposed on said carriage configured to be adjusted to accommodate an desired operational position; and a post configured to be selectively engage to a head end of said first frame, said post extending orthogonal to the plane of said first frame during operation; wherein said post is configured to selectively receive one or more elongated resistance elements.

18. The exercise device of claim 17, further comprising one or more shoulder stops configured to be selectively coupled on top of said fixed body support, said one or more shoulder stops configured to provide a fixed shoulder position during operation of said device.

19. The exercise device of claim 18, further comprising one or more elongated resistance elements configured to e selectively engage with said post and one or more of:

utilizing said one or more elongated resistance elements at a same time as said carriage to engage different muscle groups of a user during a same exercise unit; and merely utilizing said one or more elongated resistance elements without engaging said carriage at a same time.

20. An exercise device, comprising:

a first frame, said first frame being generally rectangular and having a head end and a first juncture end;

a fixed body support fixed on said first frame and configured and dimensioned to support a-torso of an exercise participant;

a second frame, said second frame being generally rectangular and comprising a second juncture end, a foot end and a pair of rail members extending along opposite sides of said second frame, respectively, between said second juncture end and said foot end, said second frame disposed adjacent to, and in generally a same plane as, said first frame during operation of said apparatus;

a carriage mounted on said second frame and configured to move along said rail members between said second juncture end and said foot end, said carriage comprising:

one or more receptacles, disposed at a third juncture end, and respectively configured to selectively receive a base resistance element engaged with said first frame; and a foot bar assembly configured to be adjustable to accommodate one or more operation positions and a stowed position;

a post selectively mounted to said head end of said first frame, said post extending orthogonal to the plane of said first frame during operation, said post configured to selectively receive one or more elongated resistance elements;

a foot board configured to be adjustably mounted to said carriage substantially perpendicular relative to said second frame;

a pair of spaced shoulder stops and a head rest, wherein said head rest is adjustably mounted to said fixed body support; and a storage compartment disposed beneath at least a portion of said fixed body support, wherein said at least a portion of said fixed body portion opens to provide access to said storage compartment and closes to a closed position used when supporting the exercise participant;

wherein said apparatus is foldable to stack said first frame on said second frame.

* * * * *